US007887229B2

(12) United States Patent
Wu

(10) Patent No.: US 7,887,229 B2
(45) Date of Patent: Feb. 15, 2011

(54) WATERPROOF MODULE FOR LED LAMP

(76) Inventor: Jiahn-Chang Wu, No. 15, Lane 13, Alley 439, Her-Chiang Street, Chutung, Hsin-Cu (TW) 310

( * ) Notice: Subject to any disclaimer, the term of this patent is extended or adjusted under 35 U.S.C. 154(b) by 163 days.

(21) Appl. No.: 11/952,639

(22) Filed: Dec. 7, 2007

(65) Prior Publication Data

US 2009/0080201 A1 Mar. 26, 2009

(30) Foreign Application Priority Data

Sep. 21, 2007 (TW) ..... 96135495 A

(51) Int. Cl.
*H01R 33/00* (2006.01)
*F21V 31/00* (2006.01)

(52) U.S. Cl. ..... 362/659; 362/652; 362/653; 362/267

(58) Field of Classification Search ..... 362/640–659, 362/249.02–249.06, 267, 158, 362–363, 362/800, 310; 257/99, 678; 439/616–619
See application file for complete search history.

(56) References Cited

U.S. PATENT DOCUMENTS 5,626,415 A * 5/1997 Huang ..... 362/650
5,685,638 A * 11/1997 Huang ..... 362/267
5,820,419 A * 10/1998 Liao ..... 439/699.2
2006/0274556 A1* 12/2006 Massabki et al. ..... 362/652

* cited by examiner

*Primary Examiner*—Thomas M Sember

(57) ABSTRACT

A waterproof ring unit is located in the opening of a socket. A ring ditch is made around the inner surface of the waterproof ring unit. When a flanged light emitting diode (LED) lamp is inserted into the socket, the ring ditch structurally couples to the flange. The waterproof ring embraces the lamp body to form a waterproof module for the LED lamp.

8 Claims, 9 Drawing Sheets

WATERPROOF MODULE FOR LED LAMP

RELATED APPLICATIONS

The present application is based on, and claims priority from, Taiwan Application Serial Number 096135495, filed on Sep. 21, 2007, the entire disclosure of which is herein incorporated by reference.

TECHNICAL FIELD

This disclosure relates to a module for a LED Lamp, more specifically, to a waterproof module for a LED lamp.

BACKGROUND

FIG. 1 shows a prior art module before assembly.

A LED lamp has a lamp body 14 and two extension leads 11, 12. LED chip 10 has a top electrode and a bottom electrode. The chip 10 is mounted on the top of the first lead 11 and electrically couples its bottom electrode to the lead 11. The top electrode of the chip 10 is wire-bonded to the second lead 12 through a metal wire 13. Ring pads 165 are on the bottom side of the substrate 16 and surround each of the corresponding plated through holes 161.

FIG. 2 shows the prior art module after assembly.

After the insertion of the two leads 11, 12 into the corresponding plated through holes 161, the leads 11, 12 are electrically coupled to the corresponding metal lines 164 on the substrate 16. The metal lines 164 are coupled to power supply source for energizing the LED lamp. Solders 162 are used for jointing the ends of the leads to the pad 165.

The drawback for the conventional art is that an air gap 163 exists between the bottom side of the lamp body 14 and the metal line 164. Moisture may enter the air gap 163, causing either oxidation of the metal lines 164 and/or to the leads 11, 12, or short-circuit between the leads 11, 12 to impair the lifetime of the LED lamp.

DETAILED DESCRIPTION

Figure 1:
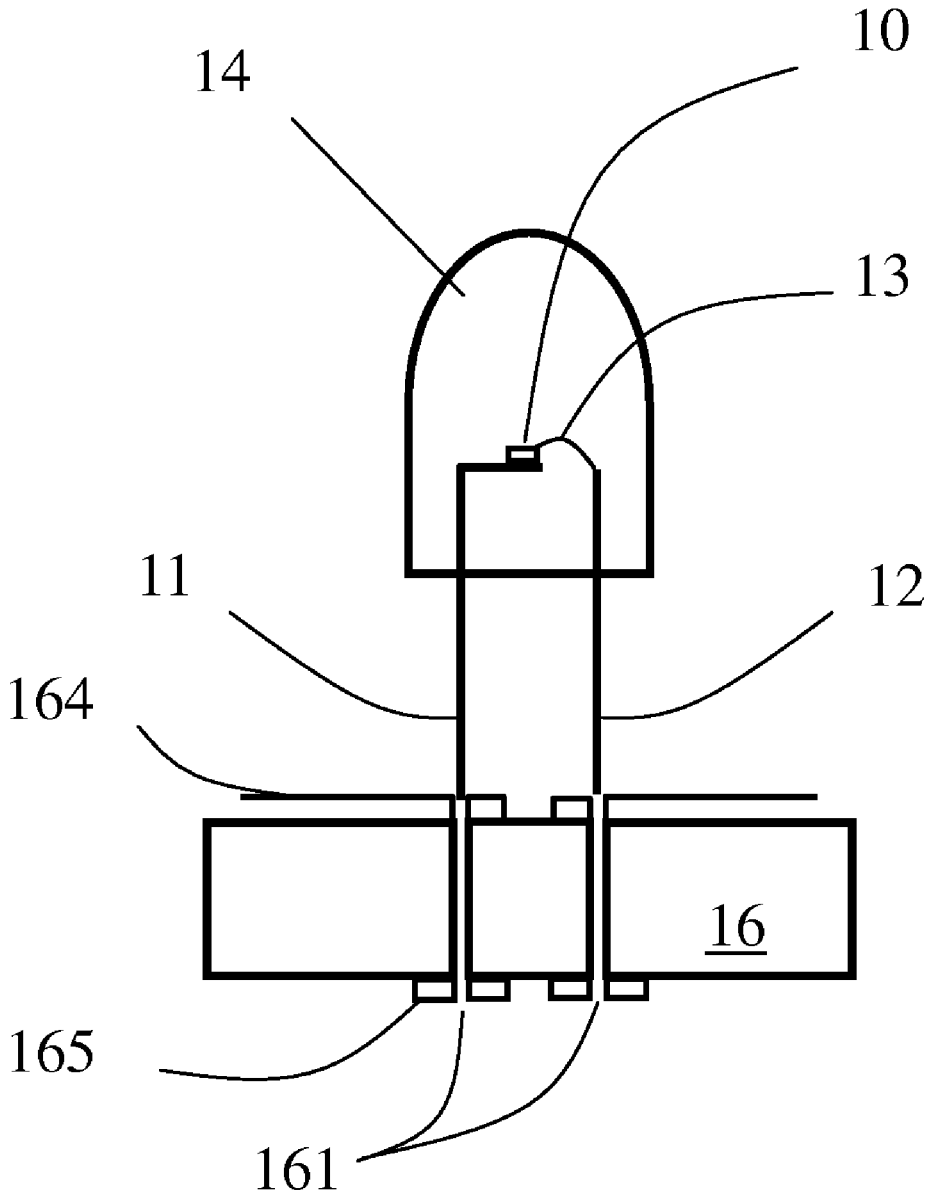
Fig. 1. Prior Art
FIG. 1 shows a prior art module before assembly.
Figure 2:
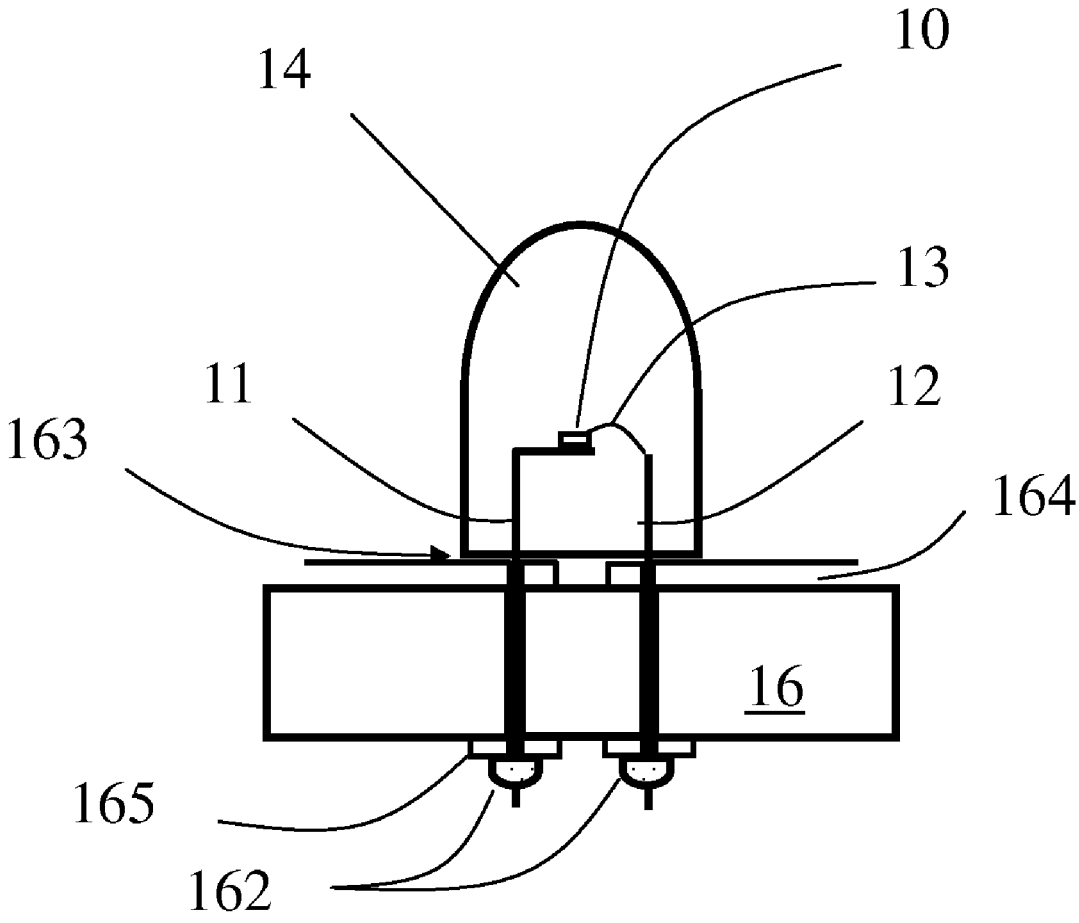
Fig. 2. Prior Art
FIG. 2 shows the prior art module after assembly.
Figure 3:
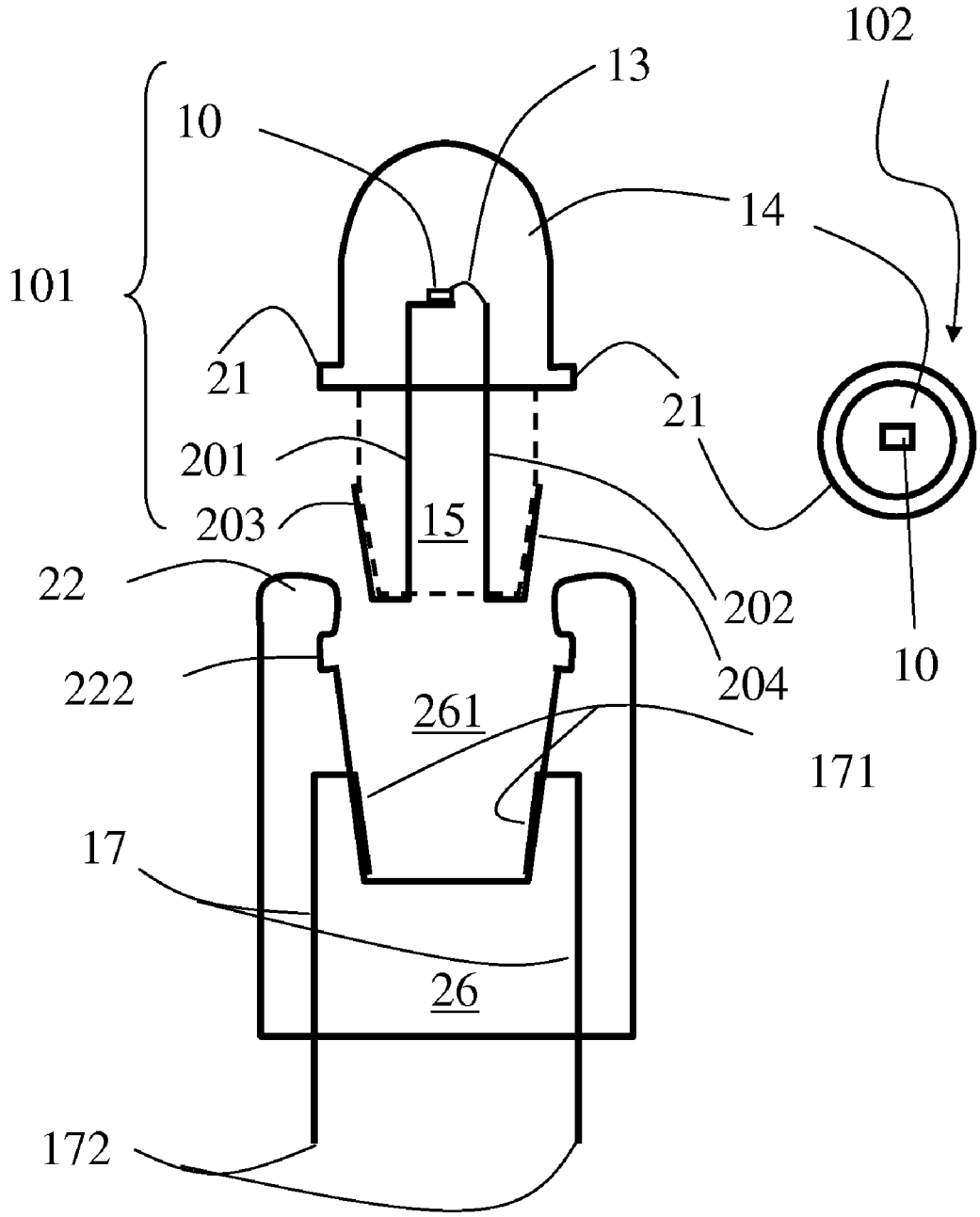
FIG. 3 shows a first module before assembly according to an embodiment of the present invention.

FIG. 3 shows a first module before assembly according to an embodiment of the present invention.

A LED lamp 101 has a lamp body 14 and two leads 201,202 extending from the bottom side of the lamp body 14. A LED chip 10 has a bottom electrode and a top electrode. The chip 10 is mounted on the top of the lead 201 and has its bottom electrode coupled to the lead 201. The top electrode of the chip 10 is wire-bonded to the lead 202 through a metal wire 13. The metal leads 201, 202 are curved up in the bottom ends to provide contact terminals 203,204. A fastener 15 is optionally used to fix the curved terminals 203,204. A flange 21 is configured to surround the bottom periphery of the lamp body 14.

The top view 102 shows that the lamp 101 has the chip 10 in the center, protected by lamp body 14 and the ring flange 21 surrounds the lamp body 14.

A socket 26 has a cup 261 in its center for housing the lamp 101, two power metals 171 are arranged on the inner wall surface of the cup 261. The power metals 171 couple to metal lines 17 and further couple to a power supply (not shown) through metal terminals 172. An elastic waterproof ring unit 22 is arranged on the open end of the cup 261. A ring ditch 222 is made around the inner surface of the opening of the waterproof ring unit 22.

Figure 4:
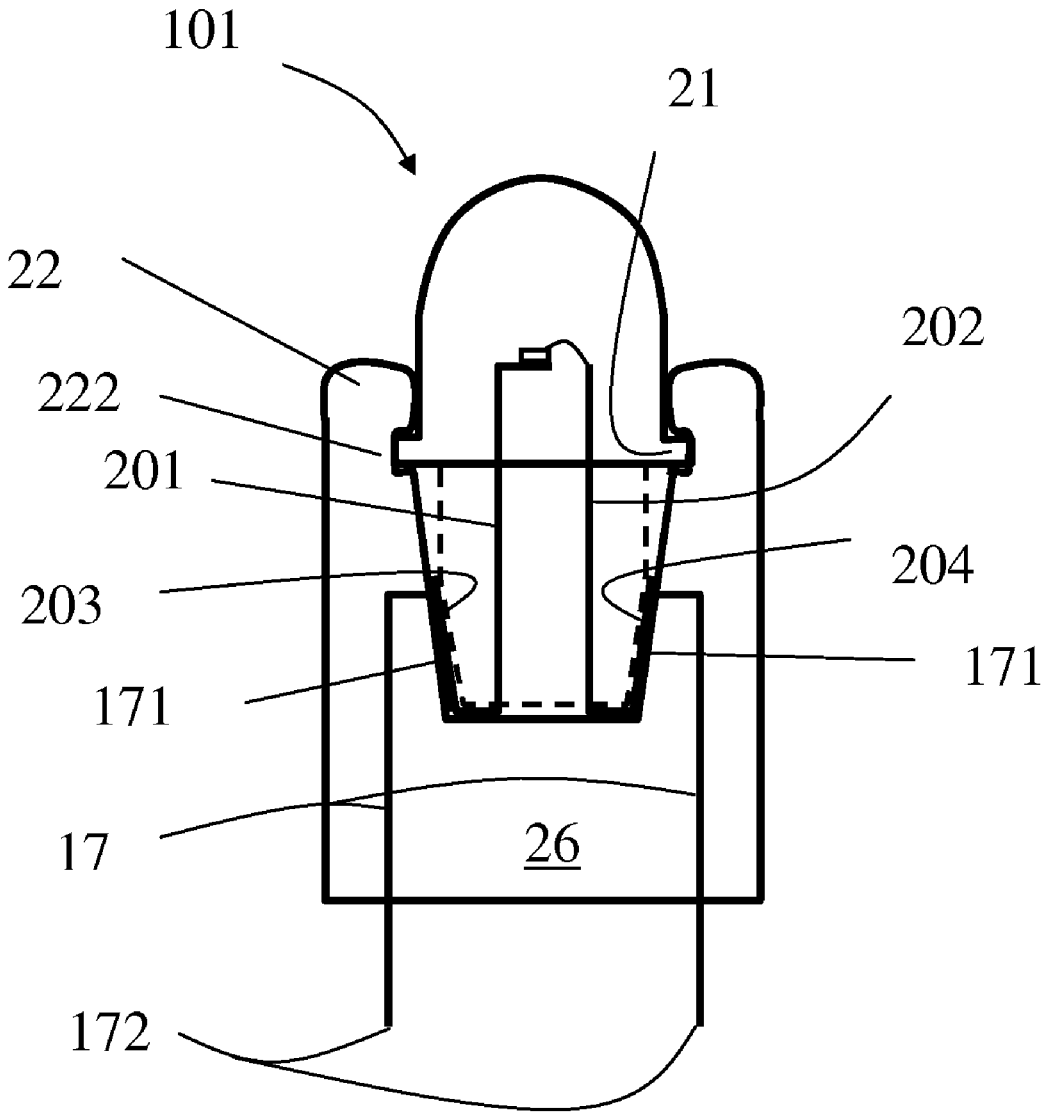
FIG. 4 shows the first module after assembly.

FIG. 4 shows the first module after assembly.

When the lamp 101 is inserted into the cup 261 of the socket 26, the leads 201,202 respectively couple to the power metals 171 through electrode terminals 203,204. The flange 21 of the lamp 101 rests inside the ditch 222 of the waterproof ring unit 22. The waterproof ring unit 22 as well as the ditch 222 embraces the lamp body 14 of the lamp 101 tightly, so that no gap exists between the lamp 101 and the waterproof ring unit 22, and hence no moisture shall enter the module.

Figure 5:
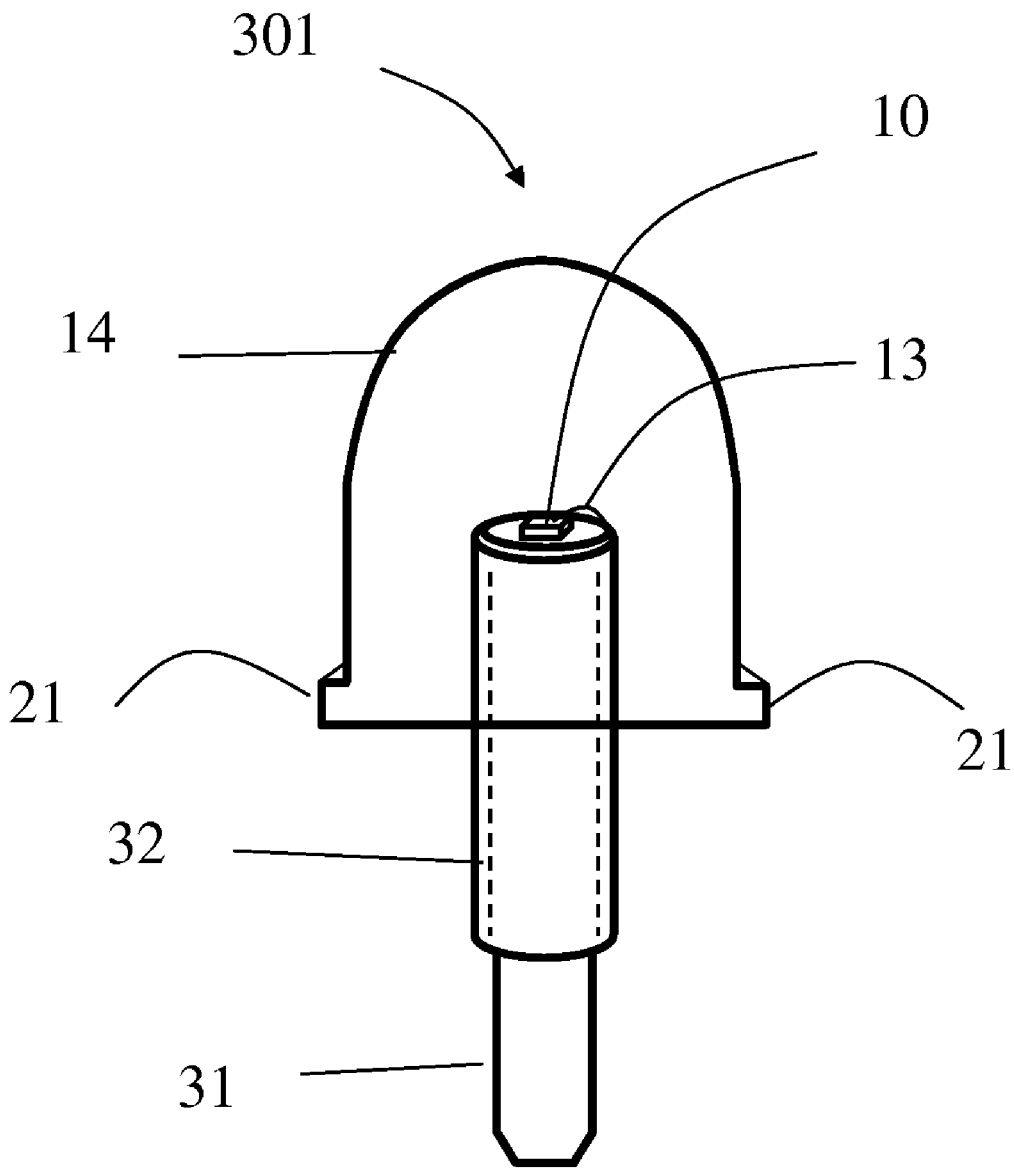
FIG. 5 shows a LED lamp that can be used in another embodiment of the present invention.

FIG. 5 shows a LED lamp that can be used in further embodiments of the present invention.

FIG. 5 shows a coaxial packaged LED lamp 301 which can be used in further embodiments of this invention. The coaxial LED lamp 301 has a lamp body 14, coaxial leads with a sleeve lead 32 encircling a center lead 31, insulation material is applied between the sleeve lead 32 and the center lead 31. A LED chip 10 has a bottom electrode and a top electrode. The chip 10 is mounted on a top surface of the center lead 31 and couples its bottom electrode to the center lead 31. The top electrode of the chip 10 is wire-bonded to the sleeve lead 32. A flange 21 is made around the bottom periphery of the lamp body 14.

Figure 6:
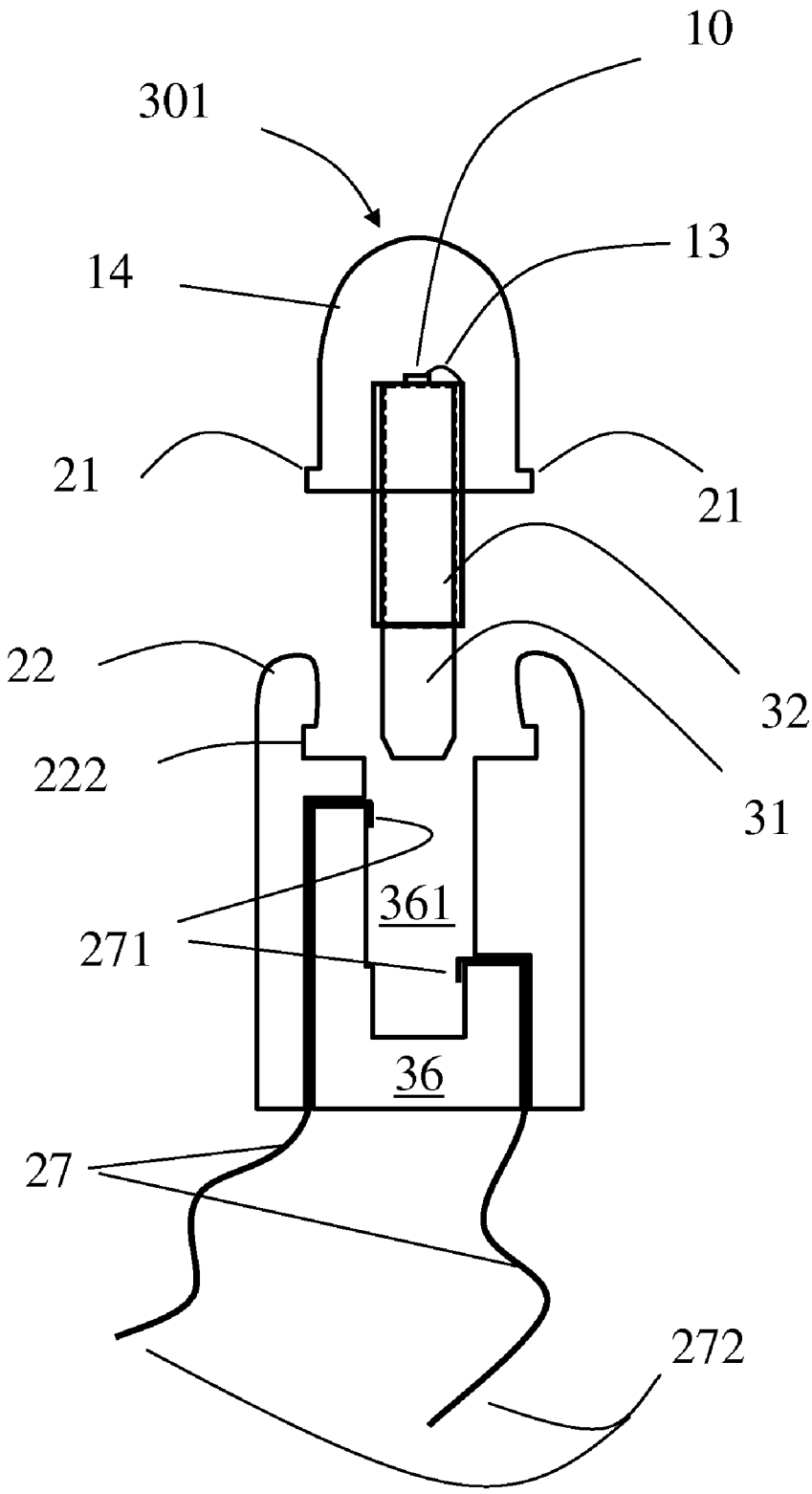
FIG. 6 shows a second module before assembly according to a further embodiment of the present invention.

FIG. 6 shows a second module before assembly according to another embodiment of the present invention.

A coaxial packaged LED lamp 301 is ready to insert into a socket 36. The socket 36 has a cup 361 in its center for housing the lamp 301, two power metals 271 are arranged on the inner wall surface of the cup 361. The power metals 271 couple to metal lines 27 and further couple to a power supply (not shown) through metal terminals 272. An elastic waterproof ring unit 22 is arranged on the open end of the cup 361. A ring ditch 222 is made around the inner surface of the opening of the waterproof ring unit 22.

Figure 7:
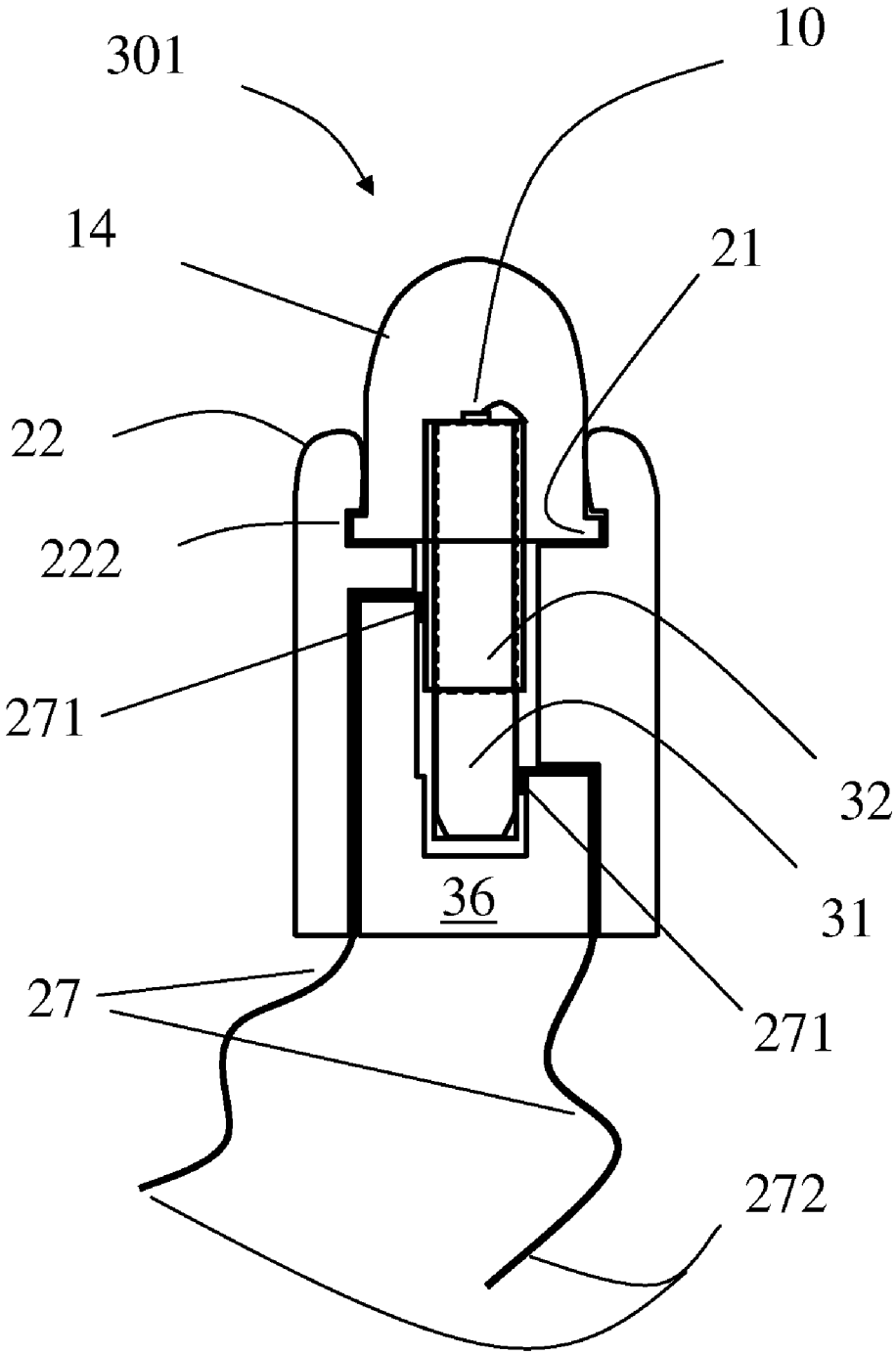
FIG. 7 shows the second module after assembly.

FIG. 7 shows the second module after assembly.

When the lamp 301 is inserted into the cup 361 of the socket 36, the leads 31,32 respectively couple to the power metals 271. The flange 21 of the lamp 301 rests inside the ditch 222 of the waterproof ring unit 22. The waterproof ring unit 22 as well as the ditch 222 embraces the lamp body 14 of the lamp 301 tightly, so that no air gap exists between the lamp 301 and the waterproof ring unit 22, and hence no moisture shall enter the module.

Figure 8:
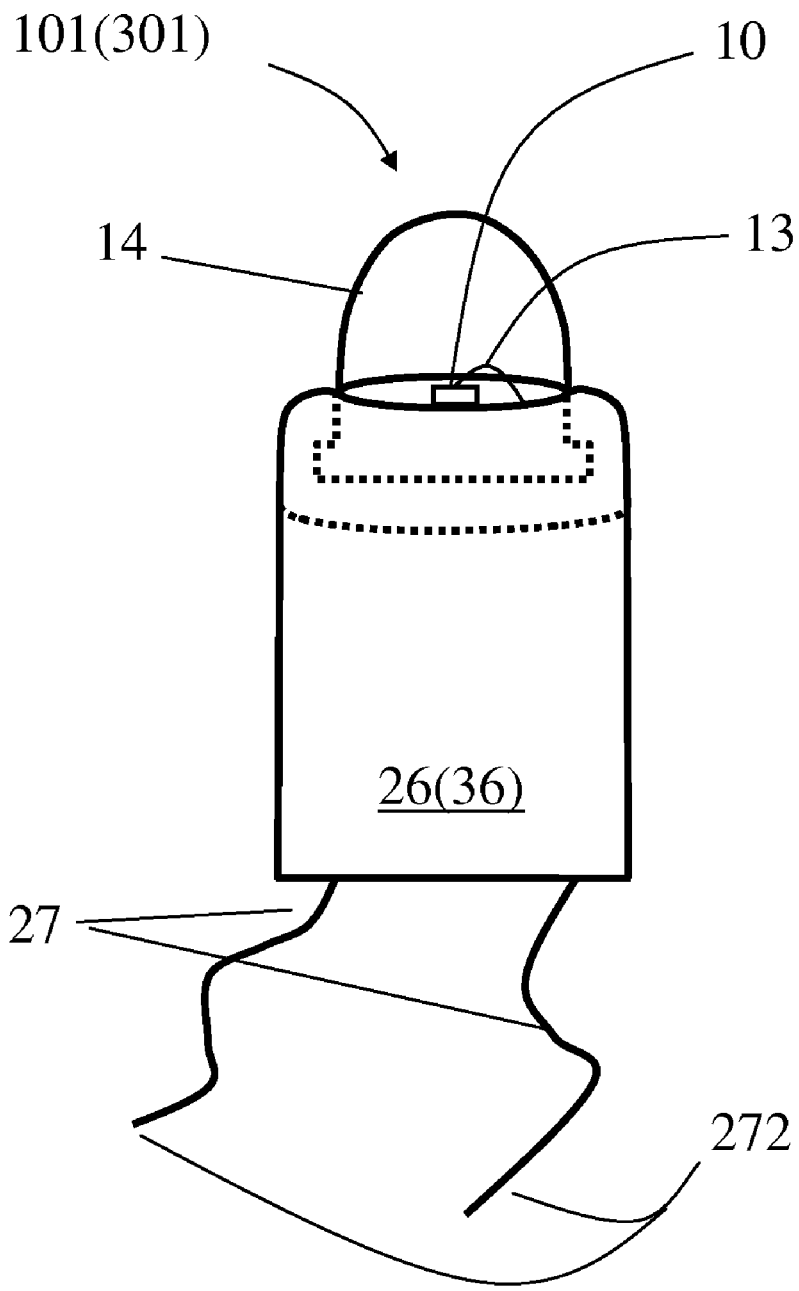
FIG. 8 shows an outline for either of the first and second modules.

FIG. 8 shows an outline for either of the first and second modules.

FIG. 8 shows the socket 26 (36) embraces the LED lamp 101 (301), so that no air gap exists to allow moisture to enter the module.

For a display composed of light pixels which is made with the modules according to this invention, the LED lamp can be replaced easily for color change or repair. The modules of invention make the display easily maintainable.

Figure 9:
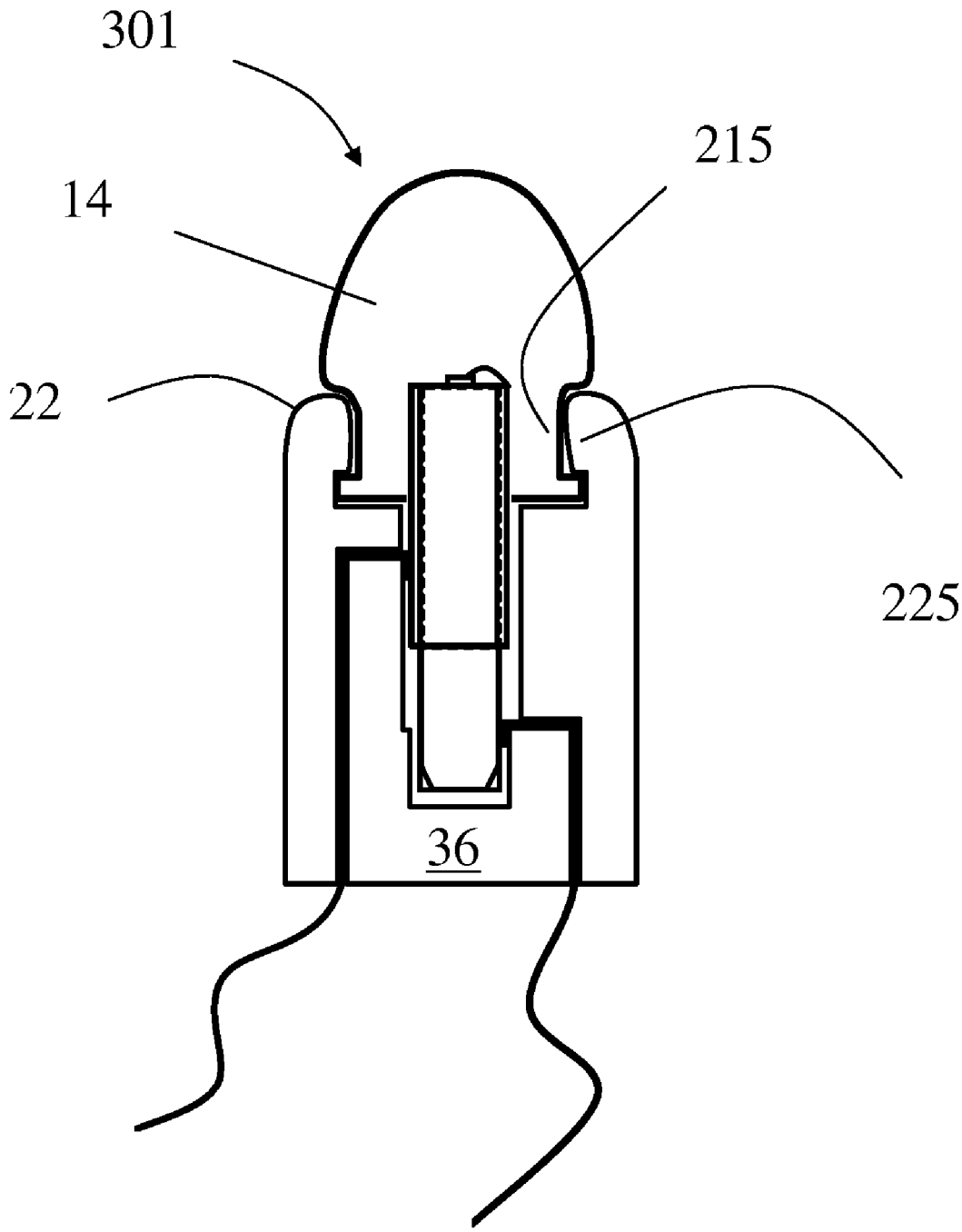
FIG. 9 shows a third module for a further embodiment of the present invention.

FIG. 9 shows a third module for a further embodiment of the present invention.

The foregoing shows a flange-ditch pair located on the open end of the cup. However, the locations of the flange and ditch can be switched with each other. FIG. 9 shows that a ditch 215 is made around the lamp body 14, a flange 225 of a waterproof ring unit 22 is configured to match with the ditch 215 to form a watertight module.

While several embodiments have been described by way of example, it will be apparent to those skilled in the art that various modifications may be made in the embodiments without departing from the spirit of the present invention. Such modifications are all within the scope of the present invention, as defined by the appended claims.

What is claimed is:

1. A waterproof module for a LED lamp, comprising:

a LED lamp, having a lamp body with two electrode terminals extending therefrom;

a socket, having a cup for housing the lamp, and two power metals on an inner wall of the cup for coupling with the electrode terminals, respectively, said cup having an open end through which the lamp body is removably insertable, in an axial direction of the cup, into the cup; and a matching pair of (a) a ditch recessed, in a radial direction of the cup, in the inner wall of the cup, and (b) a flange on the lamp body, wherein said flange and ditch are structurally engageable, with the flange being received in the ditch and completely within the cup, for watertight coupling of said LED lamp and said socket when the lamp is inserted into the socket.

2. A waterproof module as claimed in claim 1, further comprising:

a fastener for fixing the two electrode terminals in position.

3. A waterproof module as claimed in claim 1, wherein the two electrode terminals are parallel with each other.

4. A waterproof module as claimed in claim 1, wherein the two electrode terminals are coaxial.

5. A waterproof module as claimed in claim 1, further comprising:

a further matching pair of (c) a further flange on the inner wall of the cup , and (d) a further ditch on the lamp body, wherein said further flange is received in said further ditch when the lamp is inserted into the socket and the flange is received in the ditch.

6. A waterproof module as claimed in claim 1, wherein the open end of the cup comprises an elastic waterproof ring for allowing removable insertion of the lamp into the socket, and tightly embracing the lamp body in a watertight manner when the lamp has been inserted into the socket with the flange being received in the ditch.

7. A waterproof module as claimed in claim 6, wherein an outer diameter of the flange is greater than an inner diameter of the elastic waterproof ring at the open end of the cup, and the elastic waterproof ring is adapted to flex radially outwardly upon insertion of said flange through the open end into the cup, and to return radially inwardly to directly embrace the lamp body after the flange has passed through the open end to be received in the ditch.

8. A waterproof module as claimed in claim 7, further comprising a further ditch on the lamp body, wherein the elastic waterproof ring is received in said further ditch when the lamp is inserted into the socket and the flange is received in the ditch.

* * * * *